United States Patent [19]

Salcido et al.

[11] 4,284,223

[45] Aug. 18, 1981

[54] DEVICE FOR STAPLING MATERIAL ON CEILINGS

[76] Inventors: Albert R. Salcido, 1235 E. 5th Ave., Mesa, Ariz. 85204; Renato Rabago, 826 W. Louisana St., Tucson, Ariz. 85706

[21] Appl. No.: 78,444

[22] Filed: Sep. 24, 1979

[51] Int. Cl.[3] ..... B25C 1/04; B25C 7/00

[52] U.S. Cl. ..... 227/5; 227/132; 227/156

[58] Field of Search ..... 227/5, 7, 8, 9, 120, 227/132, 156, 111, 30; 294/19 R, 19 A, 20

[56] References Cited

U.S. PATENT DOCUMENTS

| | | | |
|---|---|---|---|
| 3,291,356 | 12/1966 | Armstrong | 227/156 X |
| 3,310,215 | 3/1967 | Bostick | 227/156 X |
| 3,637,127 | 1/1972 | Maier et al. | 227/9 |
| 3,767,099 | 10/1973 | Maier | 227/8 |
| 3,771,708 | 11/1973 | De Nicola et al. | 227/111 |
| 3,799,599 | 3/1974 | Jordan | 294/20 |
| 3,929,056 | 12/1975 | Lange | 227/8 |
| 3,977,088 | 8/1976 | Bondi | 227/156 X |
| 4,147,220 | 4/1979 | Swiderski et al. | 294/19 R X |
| 4,153,193 | 5/1979 | Urbanowicz | 227/156 |

*Primary Examiner*—Paul A. Bell

*Attorney, Agent, or Firm*—Cahill, Sutton & Thomas

[57] ABSTRACT

A pneumatic staple gun having a contact trigger is hingedly secured to an elongated hollow tubular handle including a hand grip adjustably positioned on the tubular handle intermediate the ends thereof. The handle includes a coupling for attachment to a high pressure pneumatic hose while the other end of the handle incorporates a flexible connection from the interior of the handle to the high pressure air input of the gun. The handle provides a conduit for high pressure air while a bracket securing the pneumatic gun to the handle permits the axis of the handle to be positioned perpendicular or parallel to a surface intended to receive staples.

3 Claims, 6 Drawing Figures

DEVICE FOR STAPLING MATERIAL ON CEILINGS

The present invention pertains to devices for stapling materials on ceilings, and particularly, to devices incorporating pneumatic stapling guns for attaching materials such as stucco netting to ceilings and higher portions of walls.

It is common construction practice to attach materials such as stucco netting to the ceilings and walls of a dwelling to receive plaster-like materials and support those materials. Such netting is placed on the ceilings by attaching the netting with staples. Typically, staple guns are used that are pneumatically actuated and which are connected to a source of air under high pressure; further, such guns are usually actuated through the combined effect of a manual trigger and a contact trigger that contacts the surface to receive the staples.

Prior art techniques usually require the operator of such a staple gun to use a ladder to place himself in a suitable position for forcing the gun against the netting and against the ceiling and subsequently to pneumatically drive a staple for attaching the netting to the ceiling. This procedure is tiresome and time consuming. Such prior art techniques are also dangerous to the workman since his attention is focused on the stapling procedure while he is attempting to reach the netting and ceiling from the steps of a ladder.

Suggestions have been made to use other types of stapling guns or devices and secure them at the end of a pole such that they can be actuated by remotely operating a trigger. However, pneumatic stapling guns are extremely effective and efficient in comparison to other types of stapling guns, although such pneumatic devices require a flexible pneumatic hose for attachment to the gun which interferes with the free operation of the gun and presents a safety hazard, both to the operator as well as to other workmen in the same room.

It is therefore an object of the present invention to provide a device for stapling material to the ceiling or high side walls of a room using pneumatically driven staples.

It is another object of the present invention to provide a device for stapling material to a ceiling incorporating an elongated tubular handle that is hingedly secured to a pneumatic stapling gun to permit the axis of the handle to be varied in relation to the stapling gun.

It is another object of the present invention to provide a device for stapling material to a ceiling using a pneumatic stapling gun wherein a passageway for the high pressure air is provided by an elongated tubular member formed by the handle.

These and other objects of the present invention will become apparent to those skilled in the art as the description thereof proceeds.

The present invention may readily be described by reference to the accompanying drawings, in which.

Figure 1:
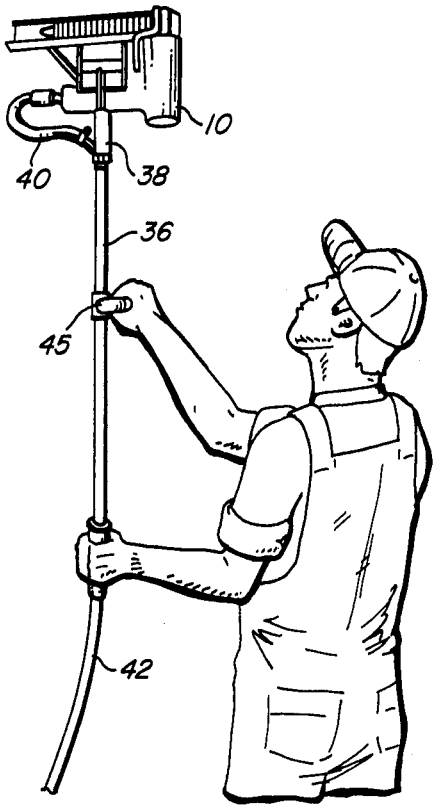
FIG. 1 is a perspective view of a device constructed in accordance with the teachings of the present invention showing the device being used by an operator.
Figure 3:
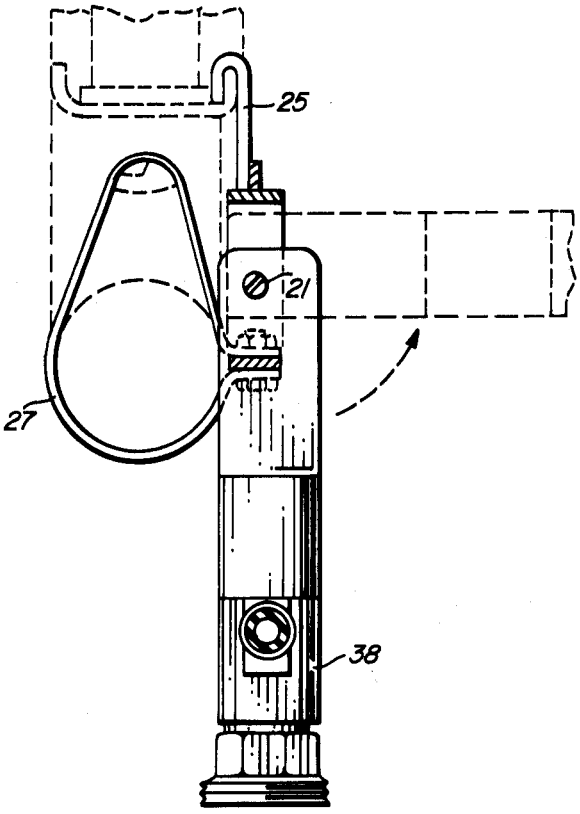
FIG. 3 is a cross-section view taken along the line 3—3 of FIG. 2.
Figure 2:
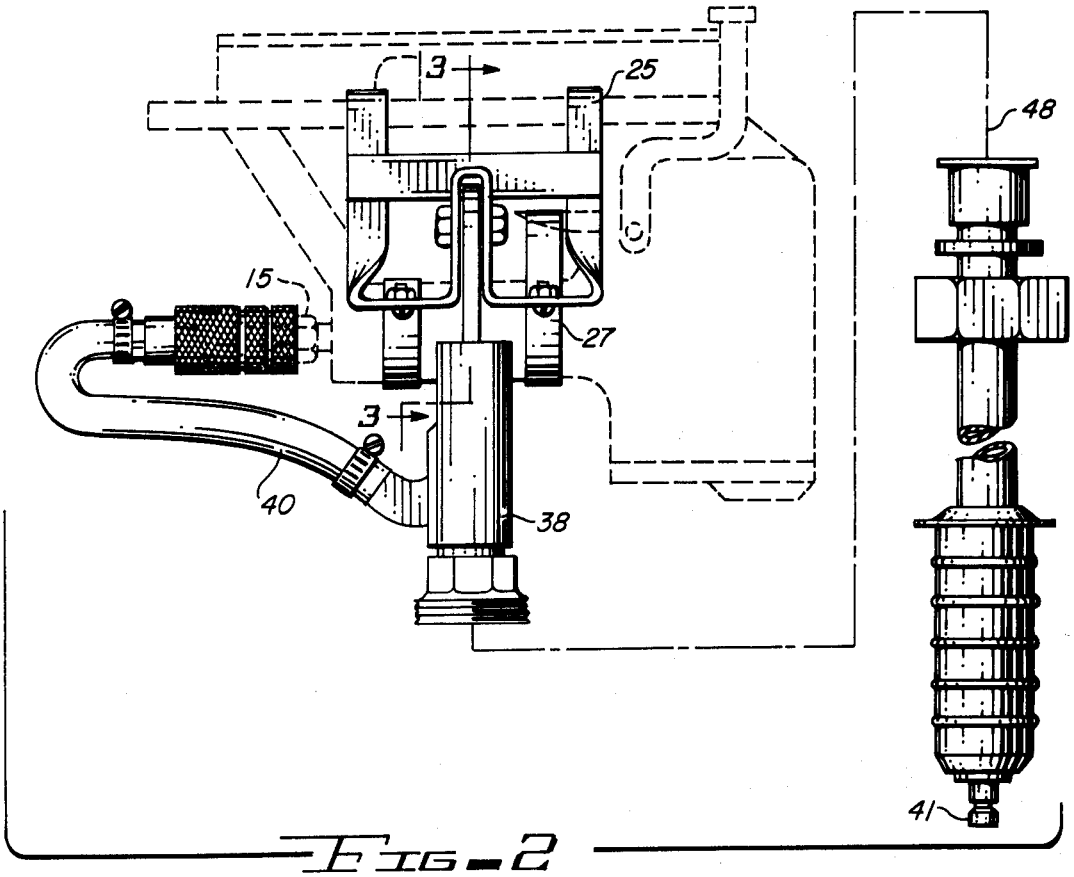
FIG. 2 is a side elevational view of a portion of the device of FIG. 1 in enlarged and exploded form.

Referring now to the drawings, a pneumatic staple gun 10 is shown having a contact trigger 11. The particular type of pneumatic staple gun is not critical and may be any of several well known devices of the type currently being manufactured and sold in the construction industry. The type chosen for illustration includes a finger trigger 12, a staple tray 14, and a high pressure air input.

A bracket, shown generally at 20, is hingedly secured by a bolt 21 to a bracket support 22. The bracket is clamped to the pneumatic gun 10 through straps 24 and 25 and clamping bands 26 and 27. It may be noted that the clamp 27 passes over the finger trigger 12 and holds the latter in its tripped or fired position. In the embodiment chosen for illustration, the continuous positioning of the finger trigger 12 renders the pneumatic staple gun actuatable by forcing the contact trigger against the surface to receive the staple.

Figure 4:
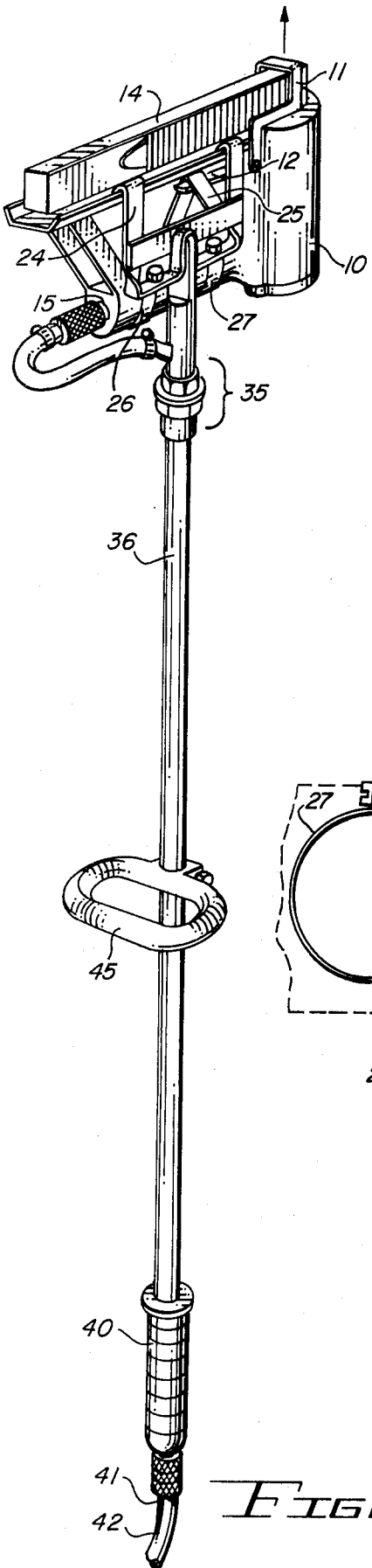
FIG. 4 is a perspective view of a device constructed in accordance with the teachings of the present invention.
Figure 6:
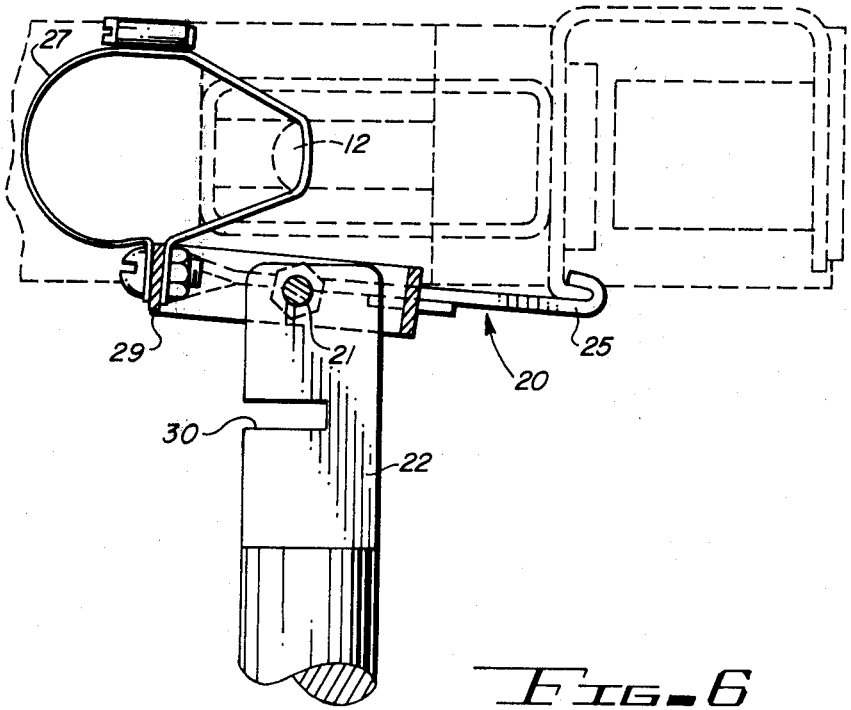
FIG. 6 is a cross-sectional view taken along line 6—6 of FIG. 5.

When the hinge 20 is in the position shown in FIG. 6, the staple gun may be used to drive staples into a vertical wall near the top of the wall that would otherwise require the use of a ladder by the operator. When the bracket 20 is pivoted about the bolt 21, the bottom portion 29 of the bracket enters a slot 30 provided in the bracket support 22 to position the staple gun as shown in FIG. 4, thereby enabling the device to be used on a ceiling.

The bracket 20, through its bracket support 22, is secured to the upper portion 35 of an elongated hollow tubular handle 36. The upper portion 35 is also provided with a suitable pneumatic coupling 38 to which a flexible pneumatic hose 40 may be secured. The other end of the hose 40 is attached to the high pressure air input 15 of the gun 10. The lower end of the elongated hollow tubular handle 36 includes a grip 40 and a coupling 41 for attachment to a high pressure pneumatic hose 42. A second hand grip 45 is adjustably positioned on the tubular handle 36 intermediate the ends of the handle.

Figure 5:
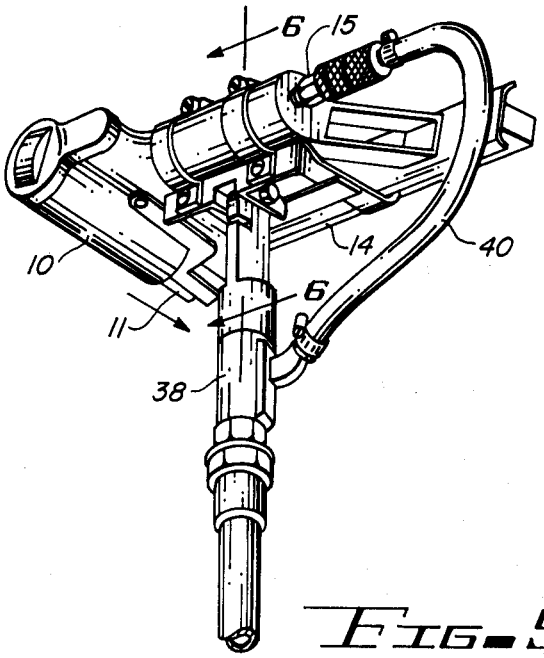
FIG. 5 is a perspective view of the upper portion of the device of FIG. 4 showing the pneumatic gun and hinge pivoted to permit the device to be used for the upper portion of side walls.

The tubular handle 36 may be provided in any of several selected lengths, depending on the height of the operator and the height of the ceiling upon which the device is to be used. The hand grip 45 may then be adjusted at a comfortable position so that the staple gun 10 may be urged against the ceiling in a manner shown in FIG. 1. When the bracket 25 is in the position shown in FIG. 1, the tubular handle 36 is positioned so that its longitudinal axis 48 is perpendicular to the ceiling. Alternatively, when the bracket 20 is pivoted, as shown in FIGS. 5 and 6, the longitudinal axis of the elongated tubular handle 36 is parallel to the side wall upon which the device is to be used. Therefore, the device of the present invention may be used not only to fasten materials such as stucco netting to the ceiling of a room, but also to the side walls near the ceiling that would otherwise require an operator to stand on a ladder to reach.

The elongated hollow tubular handle 36 provides pneumatic communication between the high pressure pneumatic hose 42 and the staple gun 10 through the flexible connection comprising the couple 38 and pneumatic hose 40. In this manner, the operator need not be concerned about a pneumatic hose dangling from the gun as it is raised into operating position. This latter feature is important in view of the fact that actuation of the pneumatic gun results in a pressure surge in the connected pneumatic hoses such that the latter have a tendency to whip during operation of the pneumatic gun. When the elongated handle 36 is used to provide pneumatic communication between the supply hose and the pneumatic gun, the interference and possible danger otherwise caused by the whipping hose extending from the ceiling has been eliminated.

We claim:

1. A device for stapling material on a ceiling and a side wall comprising:

a. a pneumatic staple gun having a high pressure air input and a contact trigger for forcing staples into a surface when said contact trigger contacts said surface;

b. an elongated hollow tubular handle having a first and a second end and including a predetermined length and a longitudinal axis;

c. a bracket hingedly securing said gun to said first end of said handle to maintain said axis either perpendicular or parallel to said surface as selected by an operator.

d. said second end having a coupling for attachment to a high pressure pneumatic hose;

e. means pneumatically and flexibly connecting said first end to said staple gun high pressure air input; and f. said tubular handle providing pneumatic communication between said high pressure pneumatic hose and said staple gun.

2. The combination set forth in claim 1 including a hand grip adjustably positioned on said tubular handle intermediate the ends thereof.

3. A device for stapling material on a ceiling and a side wall comprising:

a. a pneumatic staple gun having a high pressure air input and a contact trigger for forcing staples into a surface when said contact trigger contacts said surface, said staple gun including a depressible finger trigger for enabling said contact trigger;

b. an elongated hollow tubular handle having a first and a second end and including a predetermined length and a longitudinal axis;

c. a bracket hingedly securing said gun to said first end of said handle to maintain said axis either perpendicular or parallel to said surface as selected by an operator, said bracket including means for permanently depressing said finger trigger;

d. said second end having a coupling for attachment to a high pressure pneumatic hose;

e. means pneumatically and flexibly connecting said first end to said staple gun high pressure air input; and f. said tubular handle providing pneumatic communication between said high pressure pneumatic hose and said staple gun.

* * * * *